United States Patent [19]

Zell et al.

[11] Patent Number: 4,789,358

[45] Date of Patent: Dec. 6, 1988

[54] CABLE PLUG

[75] Inventors: Karl Zell, Niederpoecking; Peter Seidel, Groebenzell; Leo Pelzl, Holzkirchen, all of Fed. Rep. of Germany

[73] Assignee: Siemens Aktiengesellschaft, Berlin and Munich, Fed. Rep. of Germany

[21] Appl. No.: 86,270

[22] Filed: Aug. 17, 1987

[30] Foreign Application Priority Data

Sep. 25, 1986 [DE] Fed. Rep. of Germany ..... 3632600

[51] Int. Cl.[4] ..... H01R 13/658

[52] U.S. Cl. ..... 439/607; 439/92

[58] Field of Search ..... 439/607-610, 439/92, 95, 96, 108

[56] References Cited

U.S. PATENT DOCUMENTS

| | | | |
|---|---|---|---|
| 4,405,187 | 9/1983 | Muller et al. | 439/608 |
| 4,457,576 | 7/1984 | Cosmos et al. | 439/610 |
| 4,653,836 | 3/1987 | Peele | 439/610 |
| 4,685,758 | 8/1987 | Yoshida | 439/607 |

FOREIGN PATENT DOCUMENTS 2940684 7/1979 Fed. Rep. of Germany .

*Primary Examiner*—John McQuade

*Attorney, Agent, or Firm*—Hill, Van Santen, Steadman & Simpson

[57] ABSTRACT

The housing of the cable plug is exclusively formed of a one-piece metal part bent U-shaped which presses against the unit equipped with the contact spring elements under spring tension. In order for a shielding elimination to ensue on a short, direct path to a grounded potential carrier, the legs of the metal part nearly surround the unit or they even extend beyond it. In such a case, they are executed as resilient tongues with which an electrical connection to the grounded potential carrier directly ensues. Catch elements are provided for an interlocking connection of the metal part to the unit containing the spring clips or the blade strips. The web surface of the metal part proceeds at a slant relative to the bottom edges of its legs. In order to enable an oblique exit of the cable both toward the top and bottom, as well as toward the right and left, the said unit can also be engaged side-inverted without loss of positioning.

12 Claims, 2 Drawing Sheets

CABLE PLUG

BACKGROUND OF THE INVENTION

1. Field of the Invention

The invention is directed to a cable plug which accepts the end of a shielded cable and which is composed of a unit equipped with contact elements and of a housing rigidly connected to this unit which is co-utilized for shielding.

2. Description of the Prior Art

The contact elements of such a cable plug to which the leads of a switch cable are connected are brought together with corresponding cooperating contact elements during the plugging event. The shielding jacket of the cable is thereby to be brought into communication with grounded potential carriers suitable for the respective application. Given the arrangement of German published application No. 25 41 938, the shielding jacket of the switching cable is connected to a shroud which is situated in the inside of the cable plug. Individual switch wires which lead to quite specific contact elements of the cable plug are thereby connected the shroud. After the plug-in operation, a connection to grounded elements such as, for example, the carrier rails of a subrack are produced on the basis of the wiring of the corresponding cooperating contacts.

In order to be able to utilize all connector elements of a cable plug for signal transmission, a cable plug is known (German AS No. 27 40 684) whose individual component parts are joined on the basis of a carrier plate to form a housing. This metallic carrier plate is electrically connected to the shielding jacket, so that a connection to ground is enabled during the plug-in operation via contact locations provided at it. This ensues in that these contacting locations can be contacted with contact springs which are secured to the grounded carrier rails of the subrack. A relatively low-impedance connection to the grounded potential layer is thus achieved. The cable plug, however, is composed of a plurality of component parts, whereby the housing is co-fashioned by an additional carrier plate. As a result thereof, the assembly of the cable plug is also made more difficult. The shielding function is not optimum. It is also known to employ two metallic housing parts for elimination, or, respectively for the shielding function. Many joints arise in such a case, whereby the overall coupling resistance is increased. The effect of the shielding is no longer reliably guaranteed in such a case.

Increased signal processing rates, and thus, higher noise fields of the signal lines as well as the increasing number of poles of the plug connectors require an extremely effective elimination, or, respectively, shielding function.

SUMMARY OF THE INVENTION

In such a cable plug, the object of the invention is to optimize the elimination or conductive discharge of the shielding jacket of a switching cable and to simultaneously optimize the shielding function of the overall cable plug given the simplest possible structure. A reduction in the number of assembly steps is also desirable.

This is achieved for a cable plug of the type initially described in that the housing is exclusively formed of a single-piece metal part bent U-shaped and pressing against the unit equipped with the contact elements under spring tension, the legs of this metal part surrounding the unit such that these legs extend close to the edge of the unit or project beyond it, and such that a space serving for the acceptance of the cable end arises between its web surfaces and the back end face with reference to the plug-in direction of the unit; in that the metal part comprises a catch element which, after the metal part has been slipped onto the unit, engages with a catch element of the unit which corresponds therewith; in that the electrical connection to a grounded potential carrier is indirectly or directly produced via the legs.

As a result of the single-piece housing, a simple assembly derives by reducing the number of parts given simultaneous reduction in the number of assembly steps. In that the metallic housing overlaps the unit equipped with the contact elements in far-reaching fashion, the elimination or conductive discharge of the shielding jacket of a switching cable connected to it is enabled in large area fashion to a grounded potential carrier on a short, direct path. At the same time, an optimum shielding function is thus established, this being further optimized in that the cable is surrounded by the web surface. After the individual leads of the cable to be introduced have been connected, the simple joining of the housing with the unit is enabled without additional connector elements via a clamped connection achieved with the spring tension and the fixing is enabled via the interlocking catch connection.

Given a rectangular fashioning of the cable plug comprising a broad side and a narrow side, the legs overlap the surfaces belonging to the broad sides.

In accord with an improvement of the invention, the leg of the U-shaped metal part contact a grounded metallic element during the plug-in operation, this metallic element being introduced into a centering unit serving for guidance and acceptance of the cable plug. This element which, for example, contacts the legs at a number of locations can, for example, be a spring element which is in turn in direct conductive communication with the grounded potential carrier. All connector elements of the plug can be utilized for signal transmission.

In accord with a development of the invention, the legs of the metal part bent U-shaped project over the edge of the unit at both sides and are fashioned as preshaped, resilient tongues in this region. The contacting to the grounded potential carrier then ensues directly with these tongues, i.e. on the shortest possible paths. The large area contacting is further improved when every leg is divided into at least two such tongues which are respectively arched toward the contacting location.

One development provides that the spring tongue is slotted and that it engages in laterally contacting fashion into a corresponding, lateral expansion of the cut-out in the grounded potential carrier when being plugged and that the outer edge fashioned as a catch nose engages behind this plate. The spring effect is further intensified due to the slotting. A screw-type connection can also be employed for direct contacting of the cable plug housing to the grounded potential carrier. In order to improve the contacting, the screwing surface can comprise a plurality of locations raised in punctiform fashion. The grounded potential carrier can represent a shielding plate in which a corresponding cut-out is applied in the plug-in region of the cable plug for passage to the respective cooperating contacts.

When one or more of the catch elements respectively correponding to one another are present on each surface embraced by a leg, a further development of the invention provides that these catch elements are arranged such that, upon retention of the positioning of the unit, they engage under one another even given an arbitrary side position of the overlapping metal part. Even given a slanting cable guidance, it is thus possible without additional arrangements to provide the departure of the cable both at the one as well as at the other side.

BRIEF DESCRIPTION OF THE DRAWINGS

The invention shall be set forth in greater detail below with reference to an exemplary embodiment shown in the drawing. Shown are.

DESCRIPTION OF THE PREFERRED EMBODIMENTS

Figure 1:
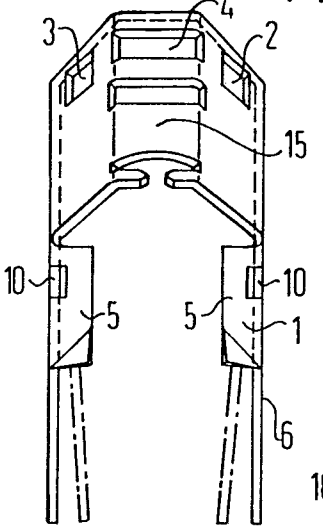
FIG. 1 is a single-piece metal part comprising an obliquely proceeding web surface.
Figure 2:
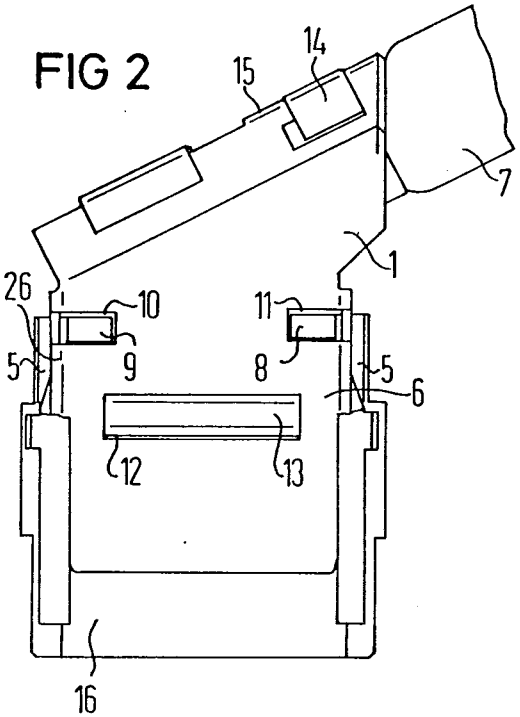
FIG. 2 is the side view of the cable plug formed by the joining of the metal part and of the unit.

After being joined with a unit 16 containing contact elements which, thus for example, represents a spring clip member, a metal part 1 shown in FIG. 1 forms the housing of the cable plug according to FIG. 2. A web surface 15 of the metal part basically bent U-shaped proceeds at a defined angle to the lower limiting line as may be seen from FIG. 2. A slanted exit for a cable 7 thus derives. The obliquely proceeding web surface 15 is subdivided into three sub-surfaces angled relative to one another. The two outer sub-surfaces include an opening 2 or, respectively, 3 and the middle sub-surface includes an opening 4. These openings serve the purpose of accepting a metal band 14 to be utilized in a known way for fastening the switching cable and its shielding jacket. The slope of the sub-surfaces relative to one another yields an approximately circular upper limitation of the acceptance space for the cable end whose individual leads are connected to the contact elements of the unit 16. This shape of the web surface 15 undertakes a centering for the cable 7 and it is also well surrounded by the metal part at the same time. The metal part 1 is composed of a spring material having good conductivity, for example of German silver sheet. As a result of the established spring action, its legs 6 are inwardly bent. This condition is shown with dot-dash lines in FIG. 1. The metal part 1 also includes tabs 5 bent at nearly a right angle relative to the legs 6. It thus becomes possible to contact these tabs to grounding springs in the plugged condition in a specific embodiment, so that an additional elimination or conductive discharge can thus ensue. These grounding springs are connectable to individual contact elements of the unit 16. Catch elements 8, 9 and 11 with which the metal housing closed at one side is fixed in position may be seen in the side view of FIG. 2. After the wiring of the cable leads, it is slipped onto the unit 16 which, for example, represents the spring clip member, upon inclusion of the cable, being slipped on in its spread condition up to the position established by the catch elements. Cutouts 10, 11 and 12 are provided in the housing part 1 as catch elements. The elements corresponding with them are the catch noses 8, 9 and 12. The catch noses 8 and 9 are applied to the corner posts 26 which are to be viewed as extensions of the corner regions of the unit 16. The aforementioned tab 5 presses against the respective sub-surface of each and every corner post which proceeds at the narrow side of the cable plug. The cutout 12 of the housing 1 surrounds the catch nose 13 of the unit 16. It would also be conceivable to provide the housing part with appropriately raised locations which then engage into corresponding depressions of the unit 16 for fixing the position of the applied housing part.

The catch locations are applied in the same fashion at the respectively other leg side of the housing 1 lying opposite. Expressed in general terms, this means that every catch position of a side face is likewise present as a mirror image at the opposite side face. What is thus achieved is that the housing 1 can also be attached to the unit 16, side-inverted given the same positioning of the unit 16. The same catch locations then serve for interlocking. As needed, the cable 7 can thus be obliquely carried away toward both sides. The space requirement needed for the cable exit is fundamentally reduced on the basis of this oblique outlet of the cable. The illustrated, compact housing shape for the cable plug is simultaneously possible on the basis of the oblique outlet.

Figure 3:
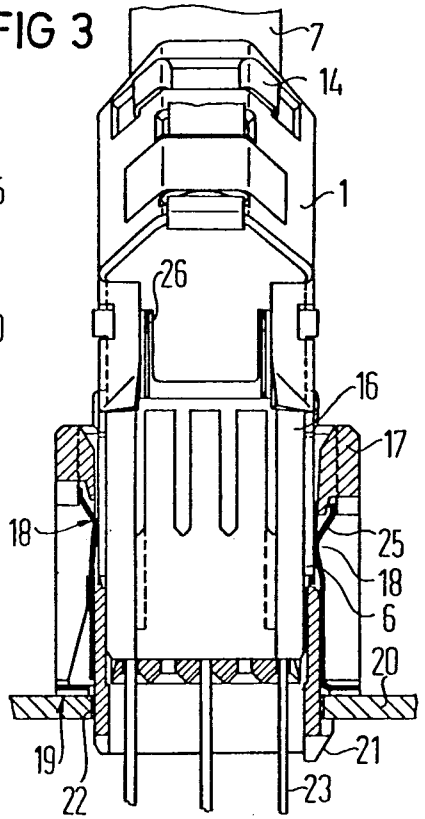
FIG. 3 is the front view of the cable plug which is introduced into a centering unit shown in section, whereby this centering unit is connected to a shielding plate.

FIG. 3 shows the centering module (shown in cross section) attached to a shielding plate 20. A centering module member 17 and an appertaining spring element 25 forming a functional unit together with it is secured to a shielding plate 20 above a recess 22 mated thereto by being simple pressed on. This ensues on the basis of a plurality of catch hooks 21 present at at least two opposite sides. After the centering unit is pressed on, these engage under the limiting line of the existing cutout which faces away from the application direction. A snap-in connection having good retention thus arises between shielding plate 20 and the centering unit 17. These catch hooks 21 are tied to the member 17 as elastic parts and are appropriately bevelled for facilitating the plug-in operation.

A cable plug shown with its standard view is introduced into the centering unit 17. Given the condition that the unit 17 is a spring clip member, for example, the cable plug is plugged onto the free ends of corresponding contact blades 23. These can be arranged at a wiring backplane of a subrack. A shielding plate 20 following thereupon which is connected to grounded potential can then serve as terminating plate. The passage 22 of this shielding plate 20 adapted to the dimensions of the centering unit is provided at the known locations at which passage for the contact blades 23 is required. The spring element 25 can be slipped onto the centering unit 17 as a prefabricated element. The existing spring tongues of the contact spring element 25 lie in a corresponding depression 24 of the centering member. As a result of a passage provided for this purpose, they have their correspondingly bent, upper region pressing against the leg 6 of the introduced cable plug. The location at which the spring element 25 joins with the shielding plate 20 is referenced 19. The electrical connection to the shielding plate is produced upon application of the centering unit. Good contact locations to the legs 6 of the housing 1 derive at the bend point 18 of the spring tongues of, for example, a one-piece spring element 25. The elimination or conductive discharge of the shielding jacket of the cable 7 to the shielding plate 20 via the contact locations 19 is thus possible on a short, direct path and in large area fashion.

Figure 4:
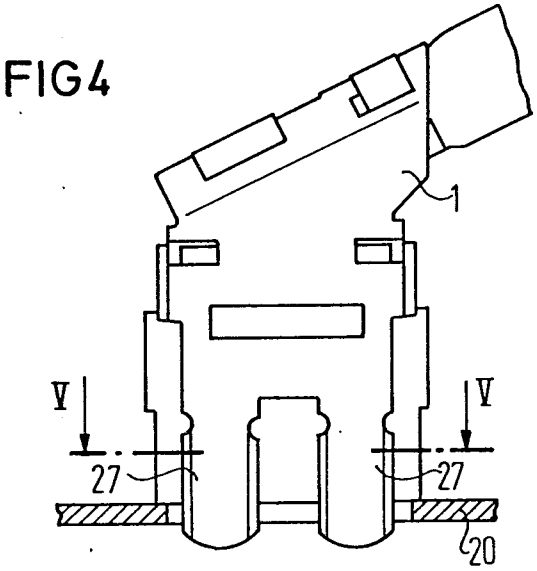
FIG. 4 is a schematic side view of a cable plug whose metal part is fashioned tongue-shaped toward the end.
Figure 5:
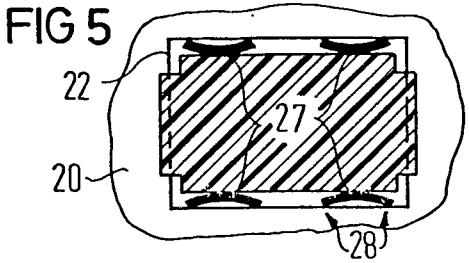
FIG. 5 is a schematic cross section through the cable plug taken generally along the line V—V in FIG. 4.
Figure 6:
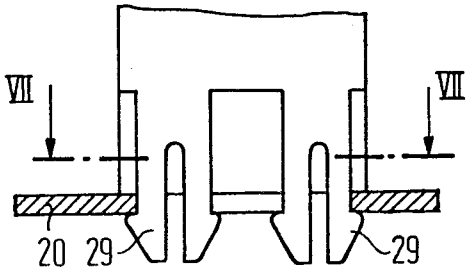
FIG. 6 is an embodiment of the spring tongues.
Figure 7:
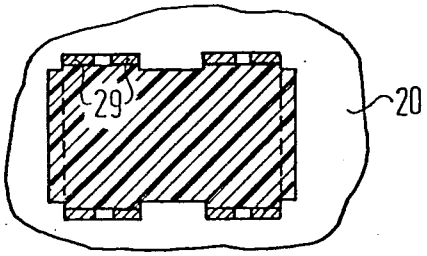
FIG. 7 is a schematic cross section taken generally along the line VII—VII in FIG. 6 showing the needed cut-out in the shielding plate.

FIG. 4 shows a schematic side view of an embodiment wherein the legs of the metal part 1 embracing the broad side of the unit 16 are fashioned as resilient tongues 27. As in FIGS. 6 and 7, guide elements for the plug are not shown in FIGS. 4 and 5. Guide elements adapted to these embodiments can, however, be utilized. The spring tongues 27 extend beyond the lower edge of the unit 16 accepting the contact elements. As shown in FIG. 5, they are arced, whereby the outside surfaces of this outward arc contact the lateral surface of the cut-out 22 present in the shielding plate 20. These contact locations 28 are repeatedly provided at every broad side. A direct transmission from the metallic housing 1 to the grounded shielding plate 20 thus ensues. This is the case in the same way as in an embodiment of the spring tongues in accord with FIG. 6. In this embodiment, the spring tongues are not arced; on the contrary, they are slotted in order to intensify the spring action. The individual spring tongues thus press resiliently against the end face of the cut-out area correspondingly expanded for their acceptance. They also have an additional catch function since their shoulder provided for this purpose engages behind the cut-out in the shielding plate 20. A spring metal having good electrical conductivity is selected for the metallic housing 1.

Another modification (not shown) is also conceivable wherein the metal part fashioned U-shaped is bent off tab-like at its end opposite the web surface 15, being bent off immediately at the lower edge of the unit 16. A screw-type connection can then be used via these tabs for direct contacting of the cable plug housing. In order to improve the contacting, the screw surface can comprise a plurality of locations raised in punctiform fashion.

As is apparent from the foregoing specification, the invention is susceptible of being embodied with various alterations and modifications which may differ particularly from those that have been described in the preceeding specification and description. It should be understood that we wish to embody within the scope of the patent warranted hereon all such modifications as reasonably and properly come within the scope of our contribution to the art.

We claim as our invention:

1. A cable plug for accepting an end of a shielded cable comprising a unit equipped with contact elements and a housing co-utilized for shielding and rigidly connected to said unit comprising:

said housing being formed by a single-piece metal part bent U-shaped comprising two legs and a web surface, said metal part, under spring tension, pressing against the unit equipped with contact elements, surrounding said unit such that said legs of the metal part extend at least close to the edge of the unit such that a space serving for the acceptance of the cable end arises between the web surface of the metal part and a back end face of the unit;

said metal part comprising a catch element which, after the metal part has been shaped onto said unit, interlocks with a corresponding catch element of the unit;

said legs producing an electrical connection to a grounded potential carrier.

2. A cable plug according to claim 1, wherein said cable plug is rectangular and comprises a pair of broad sides and narrow sides and said legs embrace surfaces on the broad sides.

3. A cable plug according to claim 1, further comprising a centering unit for accepting and guiding said cable plug, including a grounded metallic element to be contacted by the legs of the metal part.

4. A cable plug according to claim 1, wherein said legs extend beyond the edge of said unit on both sides and are formed as preformed resilient parts such that immediately after a plug-in event, a contacting to said grounded potential carrier occurs.

5. A cable plug according to claim 4, wherein each resilient part is divided into two and arched toward the contacting location, so that the cut-out edges of a cut-out in a grounded shielding plate used as the grounded potential carrier can be contacted, said cut-out being present for passage to the respective cooperating contacts.

6. A cable plug according to claim 4, wherein each resilient part is slotted and each part, during plugging, is introducable in laterally contacting fashion in a corresponding, lateral expansion of a cut-out of a shielding plate used as grounded potential carrier when the cable plug is plugged in; and in that the outer edge of every part fashioned as a catch nose engages behind this shielding plate.

7. A cable plug according to claim 1, wherein catch elements are present on every side of the unit surrounded by the legs of the metal part, said catch elements being arranged symmetrically relative to a symmetry axis of the unit proceeding in a slide-on direction, so that the metal part can be alternately slipped on in two positions offset relative to one another by 180 degrees.

8. A cable plug according to claim 7, wherein the catch element of the metal part represents a corresponding cutout and the catch element respectively corresponding thereto and engaging into this cut-out represents an elevation.

9. A cable plug according to claim 1, wherein the web surface of the U-shaped metal part proceeds at a defined angle relative to the lower edge of the cable plug.

10. A cable plug according to claim 1, wherein the web surface is formed by at least three surface parts angled relative to one another.

11. A cable plug according to claim 10, wherein said surface parts comprise openings for the acceptance of additional function elements.

12. A cable plug according to claim 1, wherein the side edges of the U-shaped metal part are at least partly expanded to form a clip bent inward approximately perpendicular to the leg, so that grounding springs additionally to be applied thereto, can be contacted.

* * * * *